US009992578B2

(12) United States Patent
Ikeda et al.

(10) Patent No.: US 9,992,578 B2
(45) Date of Patent: Jun. 5, 2018

(54) UNIDIRECTIONAL DYNAMIC MICROPHONE UNIT

(71) Applicant: KABUSHIKI KAISHA AUDIO-TECHNICA, Machida-shi, Tokyo (JP)

(72) Inventors: Tatsuya Ikeda, Machida (JP); Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days. days.

(21) Appl. No.: 15/385,097

(22) Filed: Dec. 20, 2016

(65) Prior Publication Data

US 2017/0303047 A1 Oct. 19, 2017

(30) Foreign Application Priority Data

Apr. 13, 2016 (JP) ..... 2016-080386

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/22*** | (2006.01) |
| ***H04R 1/34*** | (2006.01) |

(52) U.S. Cl.

CPC ..... *H04R 9/08* (2013.01); *H04R 1/222* (2013.01); *H04R 1/342* (2013.01)

(58) Field of Classification Search

CPC ..... H04R 9/08; H04R 1/222; H04R 1/342

USPC ..... 381/356

See application file for complete search history.

(56) References Cited

U.S. PATENT DOCUMENTS

| | | | | |
|---|---|---|---|---|
| 5,282,245 A * | 1/1994 | Anderson | H04M 1/19 379/433.03 |
| 2007/0269059 A1* | 11/2007 | Akino | H04R 1/245 381/170 |
| 2013/0070941 A1* | 3/2013 | Akino | H04R 9/025 381/122 |
| 2013/0148836 A1* | 6/2013 | Akino | H04R 19/04 381/355 |
| 2014/0355808 A1* | 12/2014 | Akino | H04R 1/2869 381/356 |

FOREIGN PATENT DOCUMENTS

| | | |
|---|---|---|
| JP | H06-48295 U | 6/1994 |
| JP | H11-196489 A * | 7/1999 |

* cited by examiner

*Primary Examiner* — Sean H Nguyen
(74) *Attorney, Agent, or Firm* — Manabu Kanesaka

(57) ABSTRACT

In a unidirectional dynamic microphone unit, a cylindrical tube is provided to cover the microphone unit, a cylindrical wall of a first cylindrical portion that is included in the cylindrical tube and extends to at least the rearward is provided with a rear sound wave introducing portion weighted such that an acoustic resistance value is gradually made smaller toward the rearward side from positions of sound holes for taking in a sound wave transmitting around from the rearward side, preferably formed of a trumpet-shaped opening, and it is possible to enhance the sensibility to sound pressures without degradation of the frequency response and the directionality.

10 Claims, 8 Drawing Sheets

UNIDIRECTIONAL DYNAMIC MICROPHONE UNIT

RELATED APPLICATIONS

The present application is based on, and claims priority from, Japanese Application No. JP2016-080386 filed Apr. 13, 2016, the disclosure of which is hereby incorporated by reference herein in its entirety.

TECHNICAL FIELD

The present invention relates to unidirectional dynamic microphone units, and in more detail, to a technology that enhances sensitivity to sound pressures without degradation of frequency response or directionality.

BACKGROUND ART

A unidirectional dynamic microphone is preferably adopted particularly in a handheld vocal microphone, and, as illustrated in FIG. 7A and FIG. 7B, there is known a method of covering a dynamic microphone unit 1 with a cylindrical tube 2 made of an acoustic resistance material as one method for enhancing sensitivity to sound pressures (refer to Japanese Unexamined Utility Model Application Publication No. H06-48295 as a similar example).

FIG. 8A illustrates a polar pattern of the dynamic microphone unit 1 covered with the cylindrical tube 2, and FIG. 8B illustrates a frequency response characterized thereof. In contrast, FIG. 9A illustrates a polar pattern of the dynamic microphone unit 1 not covered with the cylindrical tube 2, and FIG. 9B illustrates a frequency response characteristic thereof.

In a case of being covered with the cylindrical tube 2, the sensitivity to the sound pressures is higher by approximately 4 dB as compared to a case of being not covered with the cylindrical tube 2, but as understood from a contrast between FIG. 8A, FIG. 8B, FIG. 9A, and FIG. 9B, there occurs a problem that the directionality and frequency response degrade.

SUMMARY OF THE INVENTION

Accordingly an object of the present invention is to enhance sensitivity to sound pressures of a unidirectional dynamic microphone unit without degradation of frequency response and directionality.

For achieving the above object, a unidirectional dynamic microphone unit according to the present invention comprises a diaphragm having a voice coil on the backside, a magnetic circuit portion having a magnetic gap, and a cylindrical housing, wherein the magnetic circuit portion supported within the housing, and a peripheral edge portion of the diaphragm is supported by the housing such that the voice coil can vibrate within the magnetic gap, and the housing is provided with a sound hole introducing a sound wave transmitting around the housing from the rearward side to the backside of the diaphragm, the unidirectional dynamic microphone unit further comprising a cylindrical tube for accommodating therein the housing coaxially the cylindrical tube including a first cylindrical portion extending closer to the rearward side than the sound hole and a second cylindrical portion extending closer to the forward side than a front surface of the diaphragm, and a rear sound wave introducing portion provided on a cylindrical wall of the first cylindrical portion, the rear sound wave introducing portion being weighted such that an acoustic resistance value is gradually made smaller toward the rearward side from a position of the sound hole.

According to a preferred embodiment of the present invention, the rear sound wave introducing portion is formed of a trumpet-shaped opening a width of which is gradually made wider toward the rearward side from, a position of the sound hole.

More preferably a cylindrical wall of the second cylindrical portion also is provided with a front sound wave introducing portion weighted such that an acoustic resistance value is gradually made smaller toward the forward side from the front surface of the diaphragm.

Preferably the front sound wave introducing portion also is formed of a trumpet-shaped opening a width of which is gradually made wider toward the forward side from the front surface of the diaphragm.

For preventing a sound pickup axis from being inclined or shifted, at least one of a pair of the rear sound wave introducing portions and a pair of the front sound wave introducing portions may be axisymmetrically arranged on the cylindrical wall.

The cylindrical tube may be made of a metallic plate or a synthetic plastic film material without ventilation characteristics, but preferably, is formed of an acoustic resistance material including a paper material, a non-woven cloth, a mesh body or a porous plate.

According to the present invention, the cylindrical wall of the first cylindrical portion that is included in the cylindrical tube and extends closer to the rearward side than at least the sound hole is provided with the rear sound wave introducing portion weighted such that an acoustic resistance value is gradually made smaller toward the rearward side from the position of the sound hole, preferably formed of the trumpet-shaped opening. Therefore the sound wave of which a wave length in a low-tone range side is long is taken in the cylindrical tube from a width-wide section having a small acoustic resistance value, and on the other hand, the sound wave of which a wave length in a high-tone range side is short is taken in the cylindrical tube from a width-narrow section having a large acoustic resistance value. Accordingly since a driving force of the diaphragm can be obtained without generation of a dead zone in which the driving force is not generated over a wide band from the low-tone range to the high-tone range, it is possible to enhance the sensibility to sound pressures without degradation of the frequency response and the directionality.

DETAILED DESCRIPTION

Next, some embodiments of the present invention will be explained with reference to FIG. 1A to FIG. 6B, but the present invention is not limited thereto.

Figure 1A:
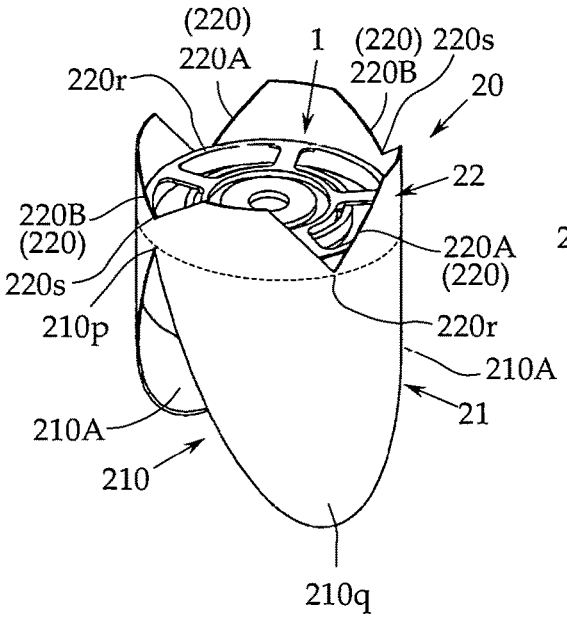
FIG. 1A is an outer appearance perspective view illustrating a first embodiment of a unidirectional dynamic microphone unit according to the present invention.
Figure 1B:
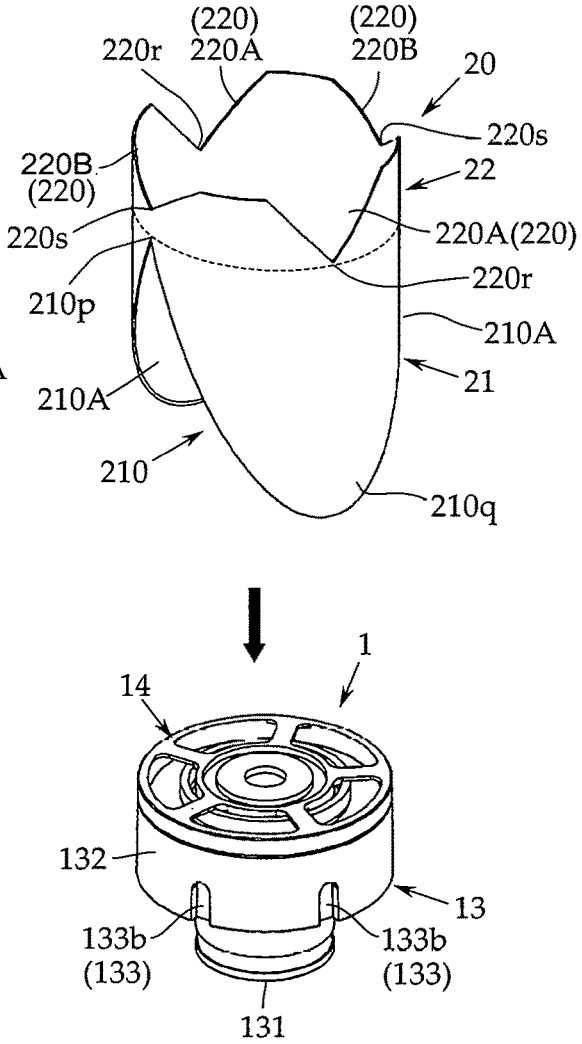
FIG. 1B is an exploded perspective view of the first embodiment.

As illustrated in FIG. 1A and FIG. 1B, a cylindrical tube 20 is used to enhance sensitivity to sound pressures also in a unidirectional dynamic microphone unit (hereinafter called "microphone unit" in some cases) 1 according to the present embodiment, but, first, the configuration of the microphone unit 1 will be explained with reference to FIG. 2.

The microphone unit 1 is provided with a diaphragm 11, a magnetic circuit portion 12 and a housing 13 supporting them, as a basic configuration.

The diaphragm 11 includes a center dorm portion 111, a sub dorm portion (called an edge portion as well) 112 and a voice coil 113.

The sub dorm portion 112 is formed coaxially on the periphery of the center dorm portion 111 as an elastic support portion. The voice coil 113 is mounted to a connecting section between the center dorm portion 111 and the sub dorm portion 112 on the backside of the diaphragm 11 through an adhesive material The magnetic circuit portion 12 includes a dish-shaped yoke 121, a ring-shaped yoke 124, a permanent magnet 122 and a center pole piece 123.

The ring-shaped yoke 124 is mounted on an opening of the yoke 121. The permanent magnet 122 is arranged on the bottom portion of the yoke 121, is formed in a disc shape, and is magnetized in the thickness direction. The center pole piece 123 is arranged on the permanent magnet 122 and forms a magnetic gap G between the ring-shaped yoke 124 and the center pole piece 123.

The housing 13 includes a cylindrical housing body 131. The housing body 131 supports the magnetic circuit portion 12, and forms a back air room having a predetermined volume on the backside of the magnetic circuit portion 12. A diameter-enlarged, flange portion 132 supporting a peripheral edge portion of the diaphragm 11 is provided on the upper end side of the housing body 131.

In the present embodiment, the flange portion 132 includes a skirt portion 132*a* arranged, on the periphery of the housing body 131 and having a larger diameter than the housing body 131. A peripheral edge of the sub dorm portion 112 in the diaphragm 11 is supported by the flange portion 132 such that the voice coil 113 can vibrate in the magnetic gap G of the magnetic circuit portion 12.

Figure 2:
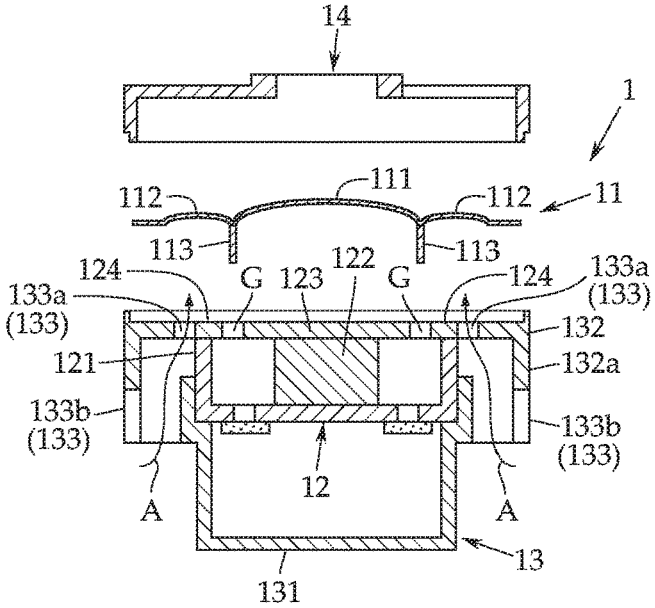
FIG. 2 is a cross section illustrating an internal structure of the unidirectional dynamic microphone unit.

Since the microphone unit 1 has a unidirectional characteristic, the housing 13 is provided with sound holes 133 that introduce a sound wave transmitting around from the rearward side in the sound waves arriving from an unillustrated forward sound source to the backside of the diaphragm 11 as illustrated in an arrow A in FIG. 2.

In the present embodiment, the sound hole 133 includes a sound hole 133*a* formed on the flange portion 132 and a sound hole 133*b* formed on the skirt portion 132*a*.

In the present embodiment, the flange portion 132 is covered with a guard member 14 for protecting the diaphragm 11 from external impacts, but instead of the guard member 14, may be covered with a resonator.

Figure 3:
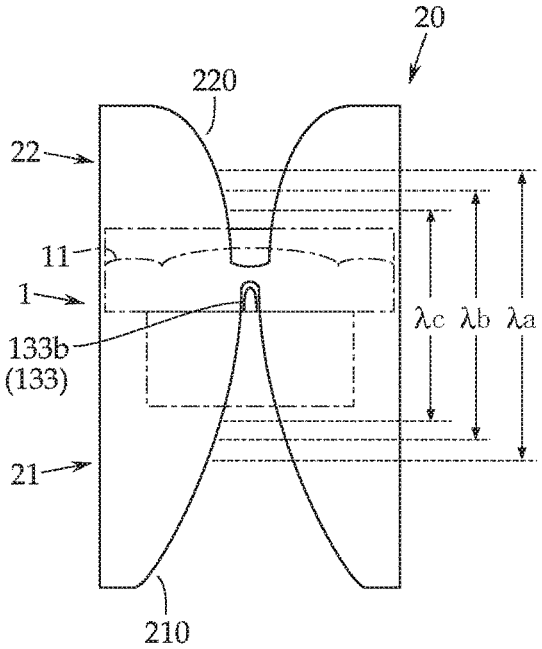
FIG. 3 is a side view explaining a relation between a sound wave introducing portion of a cylindrical tube and a wave length of a sound wave.

With reference to FIG. 1A, FIG. 1B, and FIG. 3, an inner diameter of the cylindrical tube 20 has approximately the same diameter with an outer diameter of the microphone unit 1, and the microphone unit 1 is therein accommodated coaxially. The cylindrical tube 20 is preferably made of an acoustic resistance material. The acoustic resistance material may be selected out of a paper material, a non-woven cloth, a mesh body, or a porous plate.

The cylindrical tube 20 includes a first cylindrical portion 21 and a second cylindrical portion 22. The first cylindrical portion 21 thereof extends closer to the rearward side than the sound hole 133 provided in the housing 13 (downward in FIG. 3).

On the other hand, the second cylindrical portion 22 extends closer to the forward side than the front surface of the diaphragm 11 (in a direction toward the unillustrated sound source side at the sound pickup time upward in FIG. 3). In the present embodiment, the first cylindrical portion 21 and the second cylindrical portion 22 are integrally included in the cylindrical tube 20, but may be separated.

The cylindrical wall of the first cylindrical portion 21 is provided with a rear sound wave introducing portion 210 weighted such that an acoustic resistance value is gradually made smaller toward the rearward side from a position of the sound hole 133.

In this way, a shape in which the acoustic resistance value gradually changes is preferably, as illustrated in FIG. 3, a trumpet-shaped opening a width of which is gradually made wider toward the rearward side from the position of the sound hole 133. That is, a section narrow in width has a larger acoustic resistance value and a section relatively wide in width has a smaller acoustic resistance value.

According to the present embodiment a cylindrical wall of the second cylindrical portion 22 is also provided with a front sound wave introducing portion 220 weighted such that an acoustic resistance value is gradually made smaller toward the forward side from the front surface of the diaphragm 11. Preferably the front sound wave introducing portion 220 is also formed of a trumpet-shaped opening a width of which is gradually made wider toward the forward side from the front surface of the diaphragm 11.

Here, assuming that a sound wave arriving from an unillustrated sound source includes a wave length 1*a* of a low tone, a wave length 1*b* of a middle tone, and a wave length 1*c* of a high tone (1*c*<1*b*<1*a*), according to the present embodiment, as illustrated in FIG. 3, the sound wave of the low tone of the wave length 1*a* is taken in the cylindrical tube 20 from the width-wide sections of the sound wave introducing portions 210, 220 of which the acoustic resistance value is small.

On the other hand, the sound wave of the high tone of the wave length 1*c* is taken in the cylindrical tube 20 from the width-narrow sections of the sound wave introducing portions 210, 220 of which the acoustic resistance value is large. The sound wave of the middle tone of the wave length 1*b* is taken in the cylindrical tube 20 from the intermediate sections of the sound wave introducing portions 210, 220.

In the unidirectional microphone unit 1, the diaphragm is driven by a sound pressure difference (pressure gradient) across the diaphragm, and the driving force depends on a distance between the acoustic terminals.

The acoustic terminal is a position of air that effectively gives sound pressures to the microphone unit, in other words, a center position of air moving simultaneously with the diaphragm. In the case of unidirectionally, a front acoustic terminal is present forward of the diaphragm, a rear acoustic terminal is present rearward of the backside, and a distance between the acoustic terminals is a distance between the front acoustic terminal and the rear acoustic terminal.

According to the present invention, as described above, since the respective sound waves from the low tone to the high tone are taken in the cylindrical tube 20, the acoustic terminal-to-acoustic terminal distance across the diaphragm 11 varies corresponding to each sound wave, and there does not occur the dead zone where the driving force is not generated, in a wide band from the low tone to the high tone, and the driving force of the diaphragm by the sound pressure gradient is always obtained. Therefore it is possible to enhance the sensibility to the sound pressures without degradation of the frequency response and the directionality.

Figure 4A:
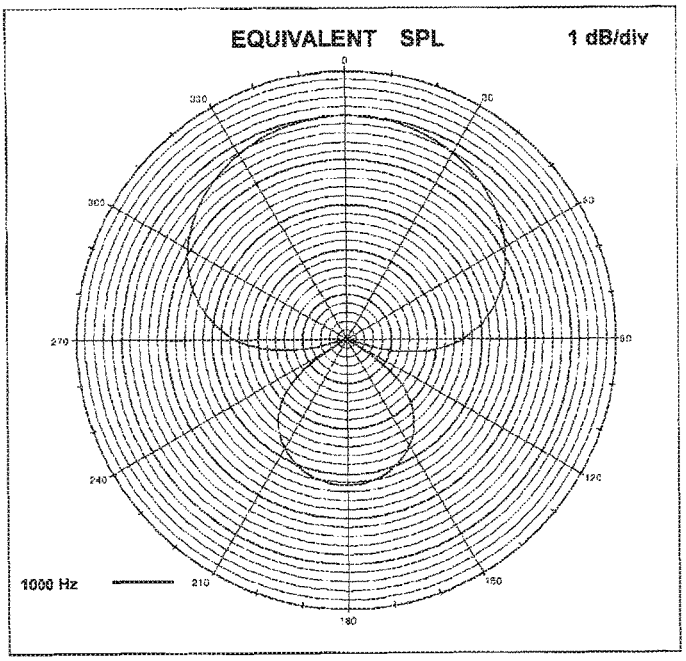
FIG. 4A is a polar pattern diagram measured in the first embodiment.
Figure 4B:
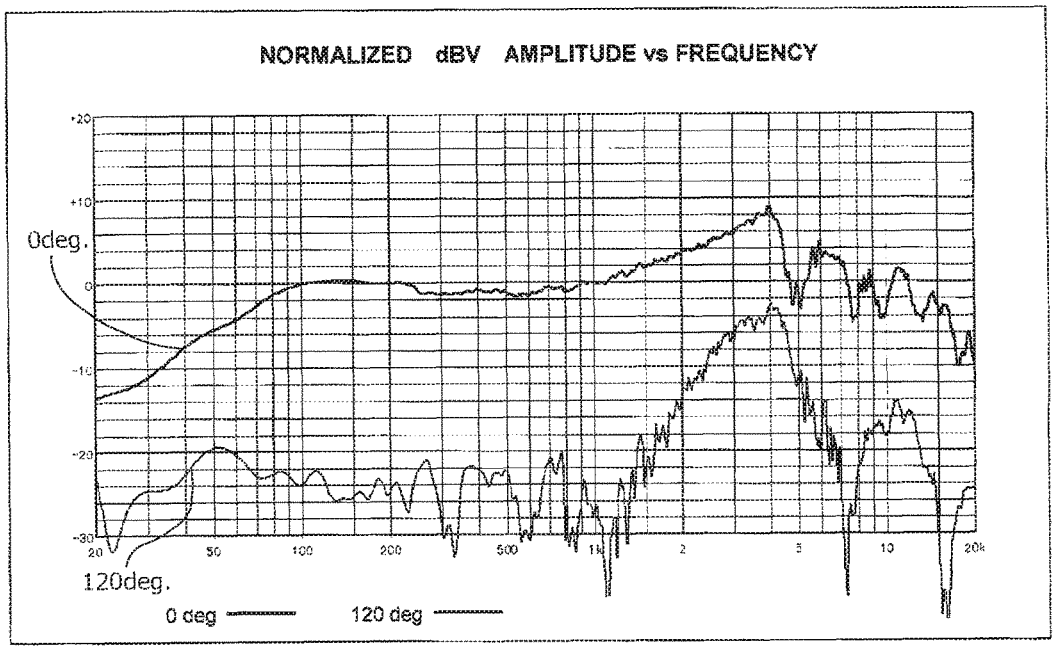
FIG. 4B is a frequency response graph measured in the first embodiment.
Figure 8A:
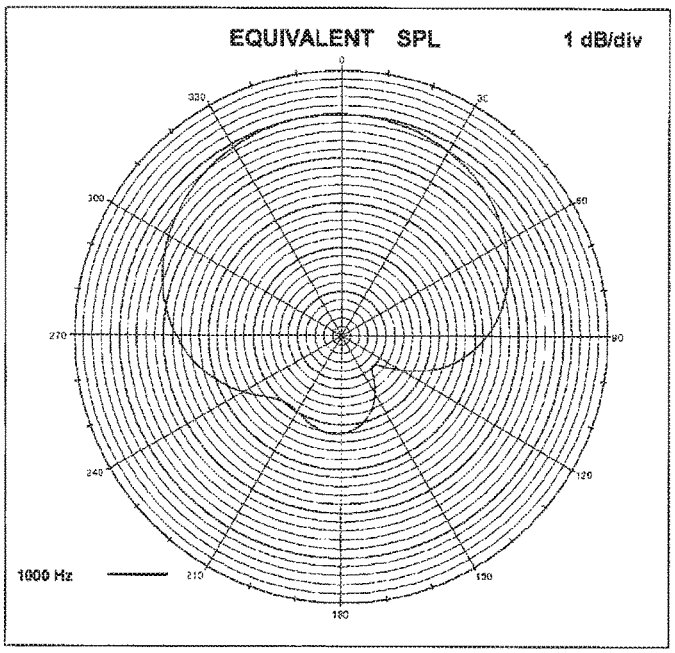
FIG. 8A is a polar pattern diagram measured in the conventional example.
Figure 8B:
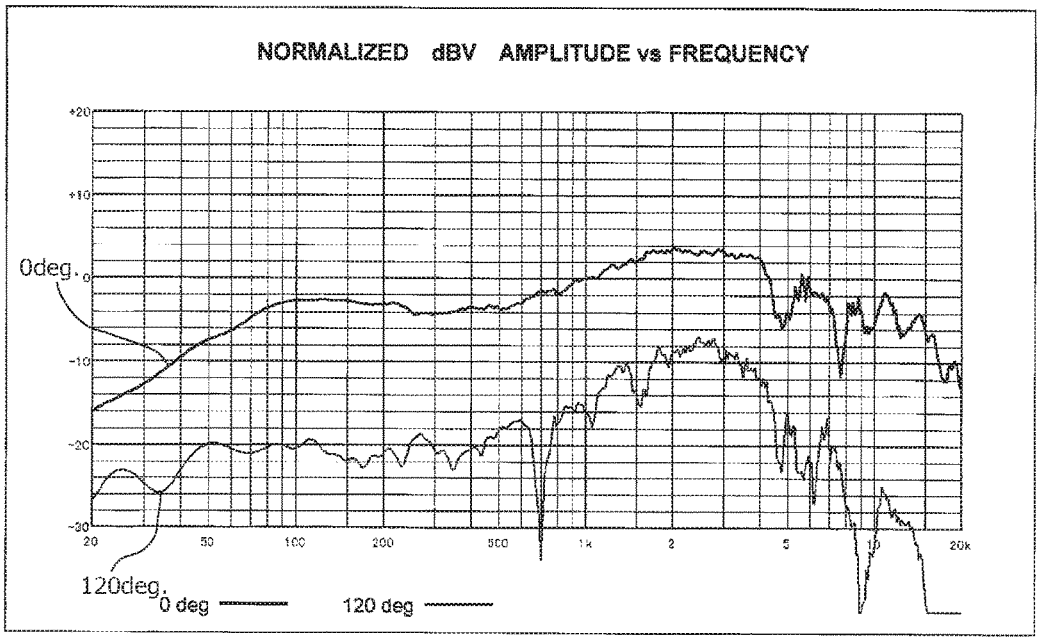
FIG. 8B is a frequency response graph measured in the conventional example.
Figure 9A:
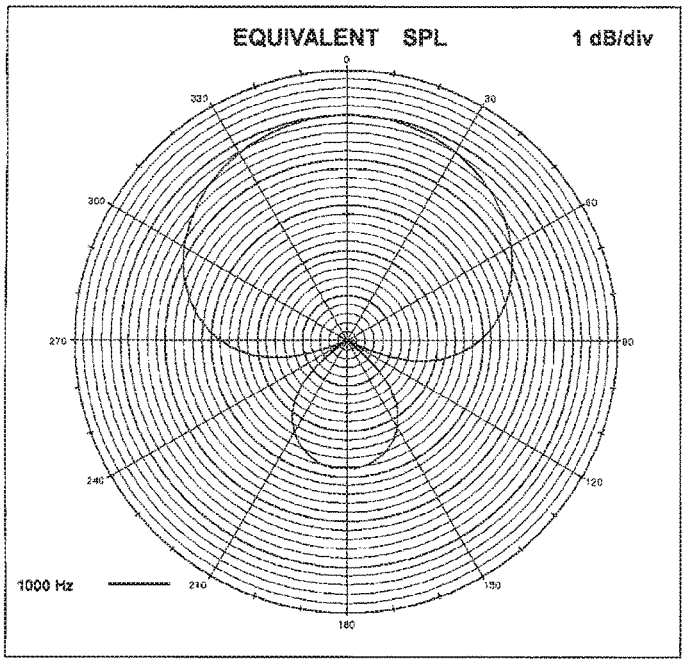
FIG. 9A is a polar pattern diagram measured in a regular unidirectional dynamic microphone unit without a cylindrical tube.
Figure 9B:
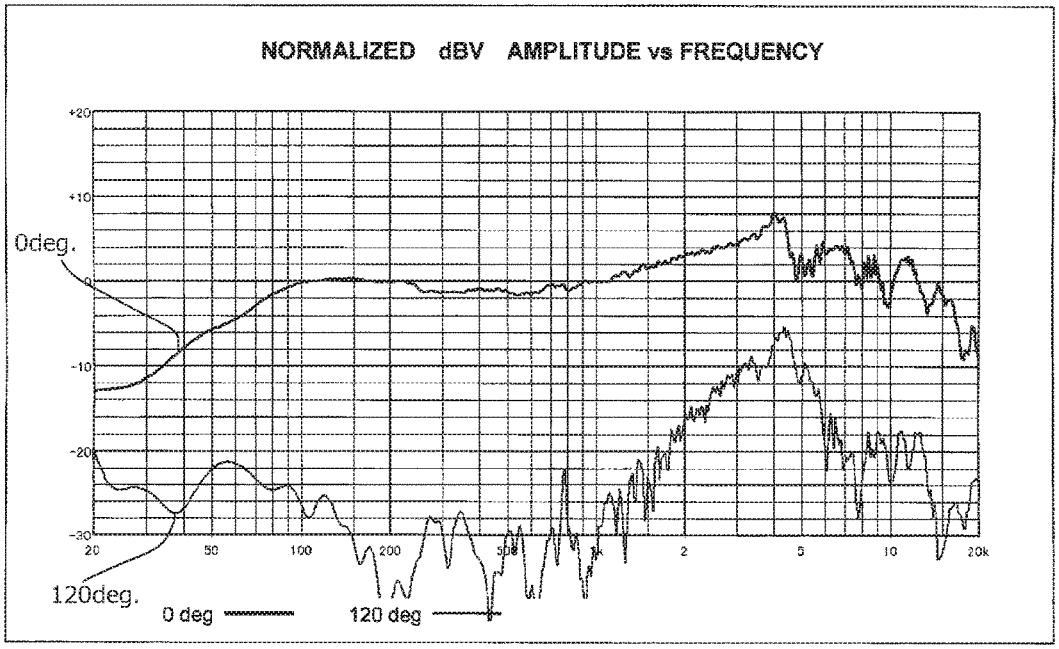
FIG. 9B is a frequency response graph measured in a regular unidirectional dynamic microphone unit without a cylindrical tube.

According to the microphone unit 1 according to the embodiment illustrated in FIG. 1A, the sensibility is made higher by approximately 1 dB as compared to the dynamic microphone unit without the covering of the cylindrical tube. FIG. 4A illustrates the polar pattern diagram of the microphone unit 1, and FIG. 4B illustrates the frequency response characteristic, and, as understood from a comparison between FIG. 8A and FIG. 8B, the directionality and the frequency response characteristic do not nearly degrade as compared to the dynamic microphone unit without the covering of the cylindrical tube.

In order that the sound pickup axis (virtual axis passing through a center of the diaphragm 11) is not shifted or inclined, it is necessary to axisymmetrically arrange at least a pair of the rear sound wave introducing portions 210 and the front sound wave introducing portions 220.

In the first embodiment in FIG. 1A and FIG. 1B, a pair (two) of the rear sound wave introducing portions 210 (210A, 210A) is axisymmetrically arranged in the first cylindrical portion 21, and two pairs (four) of the front sound wave introducing portions 220 (220A, 220A: 220B, 220B) are axisymmetrically arranged in the second cylindrical portion 22.

Here, a top portion in a reverse V-letter shape (section where the acoustic resistance value is maximized) of the rear sound wave introducing portion 210A in FIG. 3 is denoted at 210*p*, and a bottom portion thereof (section where the acoustic resistance value is minimised) is denoted at 210*q*.

The front sound wave introducing portions 220A and 220B both are formed in a V-letter shape, and the positions are shifted in the circumferential direction by 90°. A valley portion 220*r* of one first front sound wave introducing portion 220A (section where the acoustic resistance value is maximized) is deeper than a valley portion. 220*s* of the other second front sound wave introducing portion 220B.

In the first embodiment in FIG. 1, the top portion 210*p* of the rear sound wave introducing portion 210A and the valley portion 220*s* of the second front sound wave introducing portion 220B are axially opposed to each other, and the bottom portion 210*q* of the rear sound wave introducing portion 210A and the valley portion 220*r* of the first front sound wave introducing portion 220 A are axially opposed to each other.

Figure 5A:
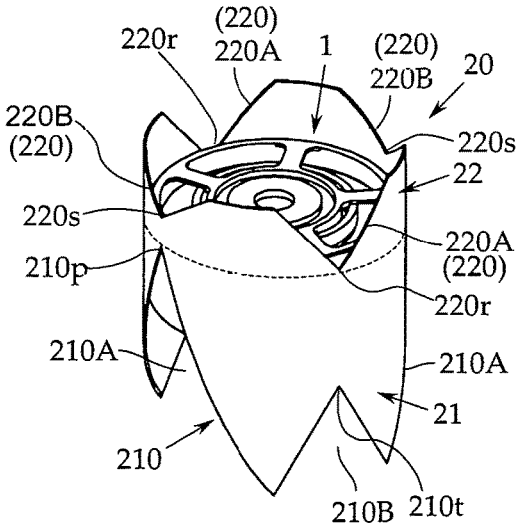
FIG. 5A is an outer appearance perspective view illustrating a second embodiment according to the present invention.
Figure 5B:
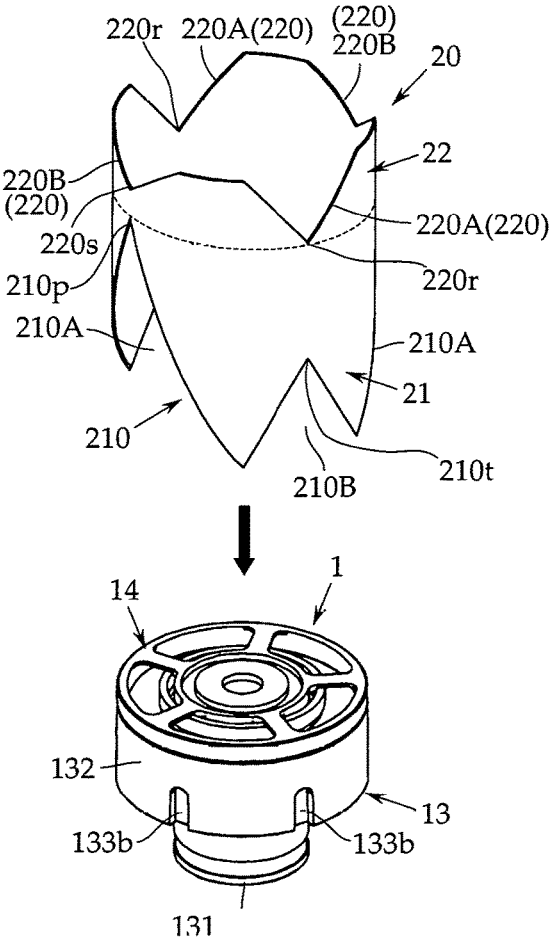
FIG. 5B is an exploded perspective view of the second embodiment.

As illustrated in FIG. 5A and FIG. 5B, as a second embodiment, the rear sound wave introducing portion 210 in the first cylindrical portion 21 may include two pairs (210A, 210A: 210B, 210B) in the same way as the front sound wave introducing portion 220. One first rear sound wave introducing portion 210A and the other second rear sound wave introducing portion 210B are shifted in position in the circumferential direction by 90°, and a top portion 210*t* of the second rear sound wave introducing portion 210B is arranged in a position lower than a top portion 210*p* of the first rear sound wave introducing portion 210A.

In the second embodiment in FIG. 5, the top portion. 210*p* of the first rear sound wave introducing portion 210A and the valley portion 220*s* of the second front sound wave introducing portion 220B are axially opposed to each other, and the top portion 210*t* of the second rear sound wave introducing portion 210B and the valley portion 220*r* of the first front sound wave introducing portion 220 A are axially opposed to each other.

The rear sound wave introducing portions 210 and the front sound wave introducing portions 220 each may include an odd number of sound wave introducing portions. In this case, the sound wave introducing portions are preferably arranged by equal intervals in the circumferential direction.

In each of the embodiments, the first cylindrical portion 21 and the second cylindrical portion 22 both are respectively provided with the rear sound wave introducing portion 210 and the front sound wave introducing portion 220, but the rear sound wave introducing portion 210 may be provided in the first cylindrical portion 21-side only, and the present invention includes this aspect as well.

Figure 6A:
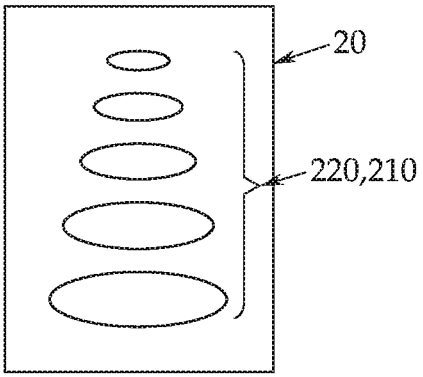
FIG. 6A is a schematic diagram illustrating a different embodiment of the sound wave introducing portion provided in the cylindrical tube.
Figure 6B:
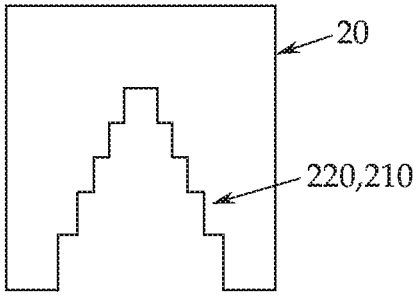
FIG. 6B is a schematic diagram illustrating a further different embodiment of the sound wave introducing portion provided in the cylindrical tube.
Figure 7A:
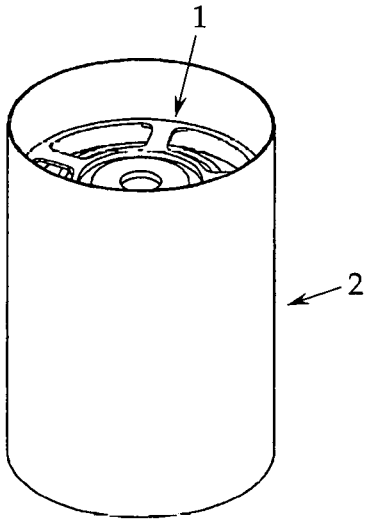
Fig.7A Prior Art
FIG. 7A is an outer appearance perspective view illustrating a conventional example of a unidirectional dynamic microphone unit equipped with a cylindrical tube.
Figure 7B:
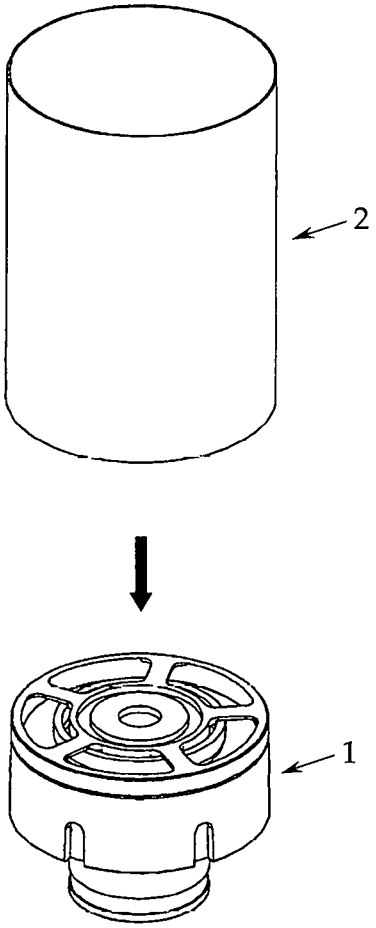
Fig.7B Prior Art
FIG. 7B is an exploded perspective view of the conventional example.

As a modification of the rear sound, wave introducing portion 210 and the front sound wave introducing port ion 220, as illustrated in FIG. 6A, the sound wave introducing portions 210, 220 may be a collection of, for example, elliptical holes (may be circular holes or angular holes) a width of which is gradually wider in an axial direction of the cylindrical tube 20 or as illustrated in FIG. 6B, may be a shape a width of which is gradually wider in an axial direction of the cylindrical tube 20 stepwise.

The invention claimed is:

1. A unidirectional dynamic microphone unit comprising:

a diaphragm having a voice coil on a backside;

a magnetic circuit portion having a magnetic gap, and arranged rearward of the diaphragm;

a cylindrical housing supporting the magnetic circuit portion therein, and supporting a peripheral edge portion of the diaphragm to allow the voice coil to vibrate within the magnetic gap, the housing being provided with a sound hole introducing a sound wave transmitting around the housing from a rear side of the housing to the backside of the diaphragm; and a cylindrical tube for accommodating therein the housing coaxially, the cylindrical tube including a first cylindrical portion extending in a rearward direction further than the sound hole, and a second cylindrical portion extending in a forward direction further than a front surface of the diaphragm;

a rear sound wave introducing portion provided in a cylindrical wall of the first cylindrical portion, the rear sound wave introducing portion being weighted such that an acoustic resistance value is gradually reduced in the rearward direction from the sound hole; and a front sound wave introducing portion provided in a cylindrical wall of the second cylindrical portion, the front sound wave introducing portion being weighted such that the acoustic resistance value is gradually reduced in the forward direction from the front surface of the diaphragm.

2. The unidirectional dynamic microphone unit according to claim 1, wherein the rear sound wave introducing portion is formed of a trumpet-shaped opening with a width gradually increasing in the rearward direction from the sound hole.

3. The unidirectional dynamic microphone unit according to claim 1, wherein the front sound wave introducing portion is formed of a trumpet-shaped opening with a width gradually increasing in the forward direction from the front surface of the diaphragm.

4. The unidirectional dynamic microphone unit according to claim 1, wherein at least one of a pair of the rear sound wave introducing portions and a pair of the front sound wave introducing portions is axisymmetrically arranged on the corresponding cylindrical wall.

5. The unidirectional dynamic microphone unit according to claim 1, wherein the cylindrical tube is made of an acoustic resistance material including a paper material, a non-woven cloth, a mesh body or a porous plate.

6. The unidirectional dynamic microphone unit according to claim 1, wherein the rear sound wave introducing portion includes a pair of first rear sound wave introducing portions arranged opposite to each other relative to a central axis of the housing, and each of the pair of first rear sound wave introducing portions is a v-shaped opening formed in the cylindrical tube and having a width gradually increasing in the rearward direction from a top portion of the first rear sound wave introducing portion to a bottom portion of the first rear sound wave introducing portion.

7. The unidirectional dynamic microphone unit according to claim 6, wherein the front sound wave introducing portion includes a pair of first front sound wave introducing portions arranged opposite to each other relative to the central axis of the housing, and a pair of second front sound wave introducing portions arranged opposite to each other in respect to the central axis of the housing, each of the pair of second front sound wave introducing portions being arranged between the pair of first front sound wave introducing portions in a circumferential direction of the cylindrical tube, the pair of first front sound wave introducing portions and the pair of second front sound wave introducing portions are v-shaped openings formed in the cylindrical tube, each of the v-shaped openings of the pair of first front sound wave introducing portions has a width gradually increasing in the forward direction from a bottom portion of the first front sound wave introducing portion to a top portion of the first front sound wave introducing portion, and each of the v-shaped openings of the pair of second front sound wave introducing portions has a width gradually increasing in the forward direction from a bottom portion of the second front sound wave introducing portion to a top portion of the second front sound wave introducing portion.

8. The unidirectional dynamic microphone unit according to claim 7, wherein the bottom portions of the pair of second front sound wave introducing portions are formed more forward than the bottom portions of the pair of first front sound wave introducing portions in an axial direction of the cylindrical tube, and aligned to the top portions of the pair of first rear sound wave introducing portions in the axial direction.

9. The unidirectional dynamic microphone unit according to claim 8, wherein the rear sound wave introducing portion further includes a pair of second rear sound wave introducing portions arranged opposite to each other relative to the central axis of the housing, each of the pair of second rear sound wave introducing portions being arranged between the pair of first rear sound wave introducing portions in the circumferential direction, and each of the pair of second rear sound wave introducing portions is a v-shaped opening formed in the cylindrical tube and having a width gradually increasing in the rearward direction from a top portion of the second rear sound wave introducing portion to a bottom portion of the second rear sound wave introducing portion.

10. The unidirectional dynamic microphone unit according to claim 9, wherein the top portions of the pair of second rear sound wave introducing portions are formed more rearward than the top portions of the pair of first rear sound wave introducing portions in the axial direction, and aligned to the bottom portions of the pair of first front sound wave introducing portions in the axial direction.

* * * * *